United States Patent [19]

Tanaka

[11] 4,121,075

[45] Oct. 17, 1978

[54] DOUBLE-BREAK PUFFER-TYPE COMPRESSED-GAS CIRCUIT-BREAKER

[75] Inventor: Masaharu Tanaka, Amagasaki, Japan

[73] Assignee: Mitsubishi Denki Kabushiki Kaisha, Tokyo, Japan

[21] Appl. No.: 745,251

[22] Filed: Nov. 26, 1976

[30] Foreign Application Priority Data

Nov. 27, 1975 [JP] Japan ..... 50-141888

[51] Int. Cl.[2] ..... H01H 33/88

[52] U.S. Cl. ..... 200/148 A; 200/148 C; 200/147 R

[58] Field of Search ..... 200/148 A, 150 G, 148 C, 200/147 R

[56] References Cited

U.S. PATENT DOCUMENTS

| | | | |
|---|---|---|---|
| 1,039,264 | 9/1912 | Dewson | 200/148 A |
| 2,095,441 | 10/1937 | Howe | 200/150 G |
| 2,959,599 | 1/1949 | Strom | 200/148 A |

FOREIGN PATENT DOCUMENTS

| | | | |
|---|---|---|---|
| 73,028 | 12/1916 | Switzerland | 200/150 G |

*Primary Examiner*—Robert S. Macon

*Attorney, Agent, or Firm*—W. A. Elchik

[57] ABSTRACT

A double-break puffer-type compressed-gas circuit-interrupter is provided having a common piston-and-cylinder arrangement for simultaneously forcing a blast of compressed gas through suitably-disposed jet apertures into a pair of serially-established arcs, the operating arrangement being such that there occurs simultaneous operation of the piston-and-cylinder arrangement, together with opening motion of the bridging cross-bar, electrically and mechanically interconnecting the two movable contacts.

An ancillary feature of the invention involves the provision of suitable arc-horns, associated with each of the break structures, so that the inherent looping of the electrical circuit through the circuit-interrupter results in electromagnetic repulsion forces, to exert an outward electromagnetic force exerted upon each of the two serially-related arcs. Preferably, laterally-disposed arc-splitters, formed of a suitable insulating material, accommodate the looping effect of the two arcs, and thus result in their considerable elongation around the spaced insulating splitters to thereby lengthen them and to attenuate the two series arcs.

6 Claims, 3 Drawing Figures

DOUBLE-BREAK PUFFER-TYPE COMPRESSED-GAS CIRCUIT-BREAKER

CROSS-REFERENCE TO RELATED APPLICATIONS

In U.S. patent application filed Mar. 21, 1975, Ser. No. 560,461, now U.S. patent 4,075,447, issued Feb. 21, 1978 to Joseph Rostron, and assigned to the Westinghouse Electric Corporation, there is illustrated and claimed the concept of a double-break, puffer-type, compressed-gas circuit-interrupter, involving two cooperable puffer structures, each of which involves a stationary piston and a surrounding movable operating cylinder, carrying therewith the movable contact structure, together with a movable orifice, or nozzle member. The operation of the aforesaid Rostron circuit-interrupter is such as to effect two serially-related arcs, while simultaneously interrelating the movable contact structure with compressing movement of the two operating cylinders over their associated stationary piston structures, to simultaneously effect independent motion of the two compressing chambers, each of which effects a blast of compressed gas into its own separate arc established through the respective nozzle structure. However, a common operating rod in the Rostron circuit-interrupter simultaneously effects piston-and-cylinder movement, together with contact separation, and also electrically interconnects the two puffer structures.

BACKGROUND OF THE INVENTION

It is well known in the circuit-breaker art to provide "puffer-type" cmpressed-gas circuit-interrupters in which a gas-compressing "puffer" cylinder is provided to interrelate movable contact-structure motion with the movable piston, or movable cylinder motion, for simultaneous arc establishment and gas-compression for arc interruption. Also, as well known in the art, there may be provided a movable orifice member of insulating material, or an insulating nozzle member movable with the movable contact structure, and serving the function of directing the compressed gas, ejected from the piston-and-cylinder arrangement, into the arc, the latter, of course, being established interiorly within the center of the aforesaid nozzle.

As the demands for interrupting capacity increase, requiring circuit-interrupters to be designed to accommodate the higher voltages and currents, the double-break type of circuit-breaker structure, involving two serially-related arcs, are a necessity to not only divide the voltage between the two interrupting structures, but also to intensify the gas blast directed into the two arcs. The aforesaid U.S. Pat. No. 4,075,447 issued to Rostron exemplifies such a double-break type of circuit-breaker structure.

SUMMARY OF THE INVENTION

In accordance with the principles of the present invention, there is provided a double-break type of puffer circuit interrupter, utilizing a common piston-and-cylinder arrangement for gas compression, in which, preferably, a stationary piston is provided, surrounded by a common movable operating cylinder, the latter additionally being mechanically connected to the conducting cross-bar for electrically interconnecting the two spaced separable contact structures.

The arrangement is such that downward opening motion of a movable operating rod simultaneously effects downward compressing movement of the movable operating cylinder, while at the same time effecting also downward opening separating motion of the two laterally-spaced movable contact structures.

Suitable jet-directing gas passages are provided on opposite sides of the common, movable, operating cylinder to effect independent gas jets at each of the two laterally-spaced contact structures, so that each of the two arcs, which are drawn, are independently blasted by its own respective gas jet.

In addition, advantage is taken of the outward electromagnetic forces exerted upon the two laterally-spaced arcs, by the inherent circuit loop through the circuit-interrupting structure to effect lateral looping of the two established arcs. Also, preferably, are disposed laterally-arranged insulating arc-splitters, which force an elongation of the established arc around the sides of the insulating splitters to thereby effect its elongation and attenuation promoting its rapid extinction.

DESCRIPTION OF THE PREFERRED EMBODIMENT

Figure 1:
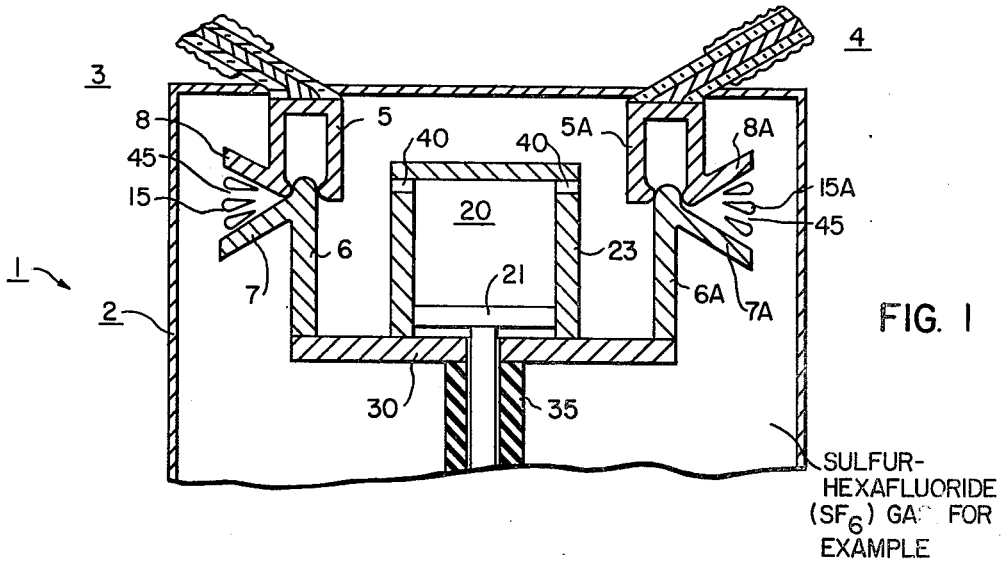
FIG. 1 is a vertical sectional-view taken through a tank-type circuit-interrupter illustrating the invention, and the contact structure being illustrated in the closed circuit position.
Figure 2:
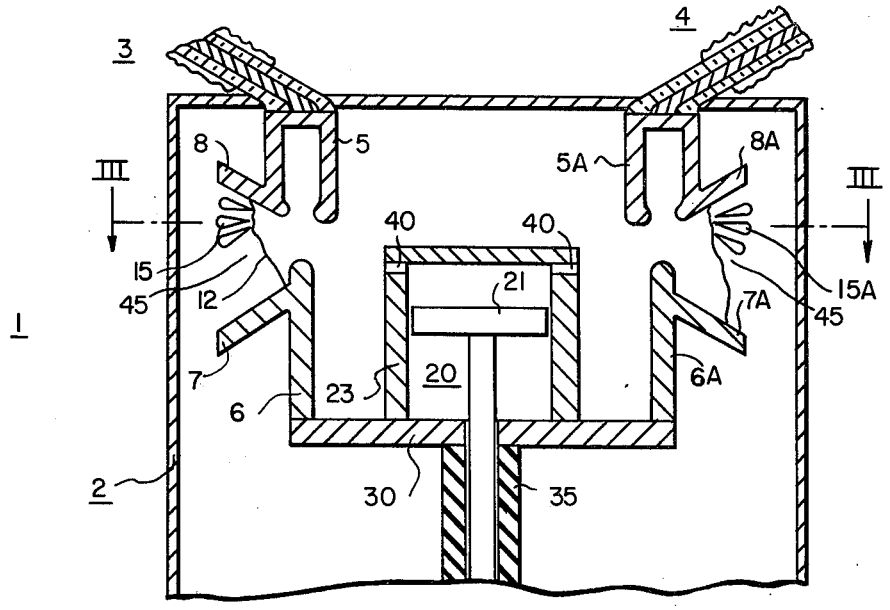
FIG. 2 is a view, similar to that exemplified in FIG. 1, but illustrating the disposition of the several parts during an intermediate portion of the opening operation, and, additionally, illustrating the two serially-related arcs, which are formed; and, FIG. 3 is a fragmentary, horizontal-secitonal-view taken substantially along the line III—III of FIG. 2.
Figure 3:
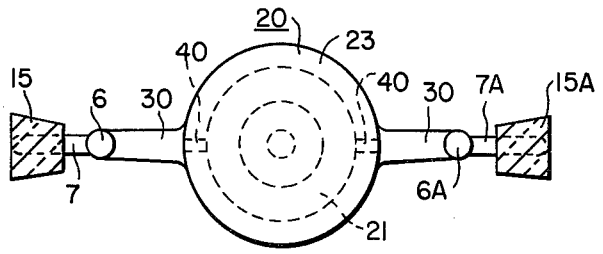

Referring to the drawings, and more particularly to FIGS. 1 and 2 thereof, the reference numeral 1 generally designates a compressed-gas type of circuit-interrupter. As illustrated, the circuit-interrupter 1 comprises a grounded, metallic tank structure 2, into which extends terminal-bushings 3 and 4 of generally conventional construction, each of which supports a relatively-stationary contact structure 5. Cooperable with each relatively-stationary contact structure 5 is a movable contact structure 6, having a laterally-arranged arc-horn 7 movable therewith. Additionally, each of the stationary contact structures 5 also has a laterally-directed arc-horn 8 forming a part thereof, so that upon arc establishment, as illustrated in FIG. 2, the arc 12 will be forced outwardly by the inherent electromagnetic forces resulting from the general looping arrangement of the series current path through the circuit-interrupter 1.

To facilitate elongation and concomitant attenuation of the established arc 12, insulating arc splitters 15 are provided. The established arc 12 is forced to elongate around the sides of the insulating splitters 15 to thereby facilitate its extinction.

Disposed somewhat centrally within the tank structure 2 is a common gas-compressing structure 20, comprising a stationary piston 21 and a surrounding movable operating cylinder 23. It will be observed that the surrounding movable operating cylinder 23 is mechanically connected to a cross-bar structure 30, the latter electrically and mechanically interconnecting the two movable contact structures 6.

A suitable operating rod 35, which, in the illustrated form of the invention may be of tubular construction, is attached to the cross-bar 30, and effects not only downward movement of the cross-bar 30, establishing the two arcs 12, but, additionally, effects downward gas-compressing movement of the movable operating cylinder 23.

It will be obvious that downward opening movement of the movable tubular operating rod 35, as effected by any suitable operating mechanism (not shown), will simultaneously effect downward opening separating motion of the two movable contact structures 6, drawing the two laterally-spaced serially-related arcs 12, but, additionally, will also effect gas compressing motion of the movable operating cylinder 23.

It will be observed that situated at the upper end of the movable operating cylinder 23 is a pair of diametrically-opposed gas-jet passages 40, which serve to direct a jet of compressed gas out of the operating cylinder 23 and toward its respective arc 12.

As mentioned, the two arcs 12 are forced to bend, or loop outwardly between the insulating arc-splitters 15 by the electromagnetic forces inherent in the electrical circuit. That is, the electrical circuit, formed by the movable contact 6 and the fixed contact 5, together with the inclusion of the other companion separable contacts 5A and 6A, together with the cross-bar 30, forms two vertical electrical current paths, the current through which are, of course, flowing in a reverse manner.

Thus, the electromagnetic forces, according to Fleming's left-hand rule, are applicable, and force the arcs to be repelled away from each other, and into the laterally-disposed insulating splitters 15.

As a result of the utilized electromagnetic forces, each arc 12 moves on to the fixed and movable arc-runners, or arc-horns 7, 8 and into the adjacently-disposed arcing chambers 45.

As shown, there simultaneously occurs a gas-compressing movement of the movable, operating cylinder 23 to thereby force a suitable gas, such as sulfur-hexafluoride ($SF_6$) gas, provided inside the tank structure 2, to be forced through the two jet-openings 40 and blown upon the respective arcs 12, and into the laterally-disposed insulating arc splitters 15. Each arc 12 is simultaneously elongated, and attenuated, while being simultaneously cooled by this blasting of the sulfur-hexafluoride ($SF_6$) gas.

When small-value amperage currents are being interrupted, the force involved by the electromagnetic repulsion is, of course, small. In this event, however, the arc is interrupted by the blasting of the sulfur-hexafluoride gas blowing, and ejected out through the two openings 40 provided in the side walls of the movable operating cylinder 23. As in the above case, the circuit-breaker of the present invention utilizes the combined action of the arc being elongated by the fluid flowing forces, and, additionally, by the electromagnetic forces brought into play by the current-loop inherent within the contact structure of the circuit-interrupter 1. Accordingly, the current-interrupting capability of the circuit-breaker 1 is increased by the simple construction, as described aforesaid.

Although there has been illustrated and described a specific structure, it is to be clearly understood that the same was merely for the purpose of illustration, and that changes and modifications may readily be made therein by those skilled in the art, without departing from the spirit and scope of the invention.

I claim:

1. A high-voltage double-break compressed-gas circuit-interrupter of the puffer-type including means defining a gas-filled enclosure, means providing a pair of spaced stationary contact structures disposed within said gas-filled enclosure, each of said relatively-stationary contact structures having an outwardly-extending arcing horn (8), a movable U-shaped rod-like conducting bridging member having outwardly-extending arcing horns disposed at the outer extremities thereof, the inner extremity of each of the two arcing horns constituting a movable contact which is engageable with a respective stationary contact for arc generation, a common gas-compressing piston-and-cylinder arrangement disposed generally centrally within said gas-filled enclosure including a common piston-part and a common cylinder-part, means mechanically connecting one of said common parts to the generally-central portion of said movable U-shaped rod-like conducting bridging member to be carried thereby for causing the simultaneous actuation of said common gas-compressing arrangement with establishment of said double series arcs, a pair of oppositely-directed gas-ejector aperture openings associated with said common gas-compressing piston-and-cylinder arrangement for directing a pair of oppositely-directed flows of compressed gas into the two serially-related arcs to effect thereby their extinction, and the outer leg portions of said movable U-shaped rod-like conducting bridging member being disposed in such close proximity that the oppositely-directed current flows within said two leg portions will generate an electromagnetic field about each leg portion to thereby repel the two generated arcs outwardly upon the two pairs of arcing horns while the arcs themselves are simultaneously reacted upon by the two outwardly-directed gas-jet flows.

2. The compressed-gas puffer-type circuit-interrupter of claim 1, including means defining a plurality of spaced insulating splitter plates associated with each arc to cause its elongation around the splitter plates and thereby facilitate arc interruption.

3. The combination according to claim 1, wherein said gas-filled enclosure comprises a grounded metallic gas-filled tank structure, and a pair of terminal-bushings extend into said grounded metallic gas-filled tank structure and support the two spaced relatively-stationary contact structures laterally apart.

4. The combination according to claim 1, wherein the common cylinder-part is mechanically connected to the central portion of the movable U-shaped rod-like conducting bridging member.

5. The combination according to claim 1, wherein the gas-jet means comprises a pair of diametrically-opposed openings located at the upper end of the movable common cylinder-part, each of said gas-jet openings being directed toward one of said respective two series arcs.

6. The combination according to claim 1, wherein the common piston-part is stationary being supported upon a stationary support rod, and the operating means for the movable U-shaped rod-like conducting bridging member includes a tubular movable insulating operating rod surrounding said stationary support rod for thereby supporting the stationary piston, and said tubular operating rod additionally being fixedly secured to the central portion of the movable U-shaped rod-like conducting bridging member for causing the opening and closing motions thereof.

* * * * *